US010555603B2

(12) United States Patent
You et al.

(10) Patent No.: US 10,555,603 B2
(45) Date of Patent: Feb. 11, 2020

(54) HEIGHT ADJUSTABLE WORKSTATION

(71) Applicant: Lumi Legend Corporation, Ningbo (CN)

(72) Inventors: Xiadong You, Ningbo (CN); Yijun Liu, Ningbo (CN); Junmin Jin, Ningbo (CN)

(73) Assignee: LUMI LEGEND CORPORATION, Ningbo (CN)

( * ) Notice: Subject to any disclaimer, the term of this patent is extended or adjusted under 35 U.S.C. 154(b) by 0 days.

(21) Appl. No.: 15/824,834

(22) Filed: Nov. 28, 2017

(65) Prior Publication Data

US 2018/0146775 A1 May 31, 2018

Related U.S. Application Data

(60) Provisional application No. 62/458,147, filed on Feb. 13, 2017, provisional application No. 62/426,650, filed on Nov. 28, 2016.

(51) Int. Cl.

| | |
|---|---|
| ***A47B 9/16*** | (2006.01) |
| *A47B 9/02* | (2006.01) |
| *A47B 21/02* | (2006.01) |

(52) U.S. Cl.

CPC ..... *A47B 9/16* (2013.01); *A47B 9/02* (2013.01); *A47B 21/02* (2013.01); *A47B 2200/0063* (2013.01)

(58) Field of Classification Search

CPC ..... A47B 9/16; A47B 9/02; A47B 2200/0063; A47B 21/02; A47B 2003/025; A47B 3/02

USPC ..... 108/144.11, 118–120

See application file for complete search history.

(56) References Cited

U.S. PATENT DOCUMENTS

| | | | | |
|---|---|---|---|---|
| 5,588,377 | A * | 12/1996 | Fahmian | A47B 9/00 108/145 |
| 7,535,002 | B2 | 5/2009 | Johnson et al. | |
| 7,538,326 | B2 | 5/2009 | Johnson et al. | |
| 7,994,480 | B2 | 8/2011 | Johnson et al. | |
| 8,466,422 | B2 | 6/2013 | Johnson et al. | |
| 8,531,562 | B2 | 9/2013 | Schmidt et al. | |
| 8,671,853 | B2 | 3/2014 | Flaherty | |
| 9,113,703 | B2 | 8/2015 | Flaherty | |
| 9,277,809 | B2 | 3/2016 | Flaherty et al. | |
| 9,289,058 | B2 * | 3/2016 | Flaherty | A47B 9/16 |
| 9,554,644 | B2 | 1/2017 | Flaherty et al. | |
| 9,568,391 | B2 | 2/2017 | Linford et al. | |
| 9,808,080 | B2 * | 11/2017 | Chung | A47B 9/16 |
| 10,085,550 | B1 * | 10/2018 | Hsu | A47B 9/16 |
| 10,092,089 | B1 * | 10/2018 | Yuan | A47B 9/16 |
| 2007/0259554 | A1 | 11/2007 | Lindblad et al. | |
| 2013/0321641 | A1 | 12/2013 | McManus et al. | |

(Continued)

*Primary Examiner* — Daniel J Troy
*Assistant Examiner* — Timothy M Ayres
(74) *Attorney, Agent, or Firm* — Knobbe Martens Olson & Bear LLP

(57) ABSTRACT

An adjustable workstation is described. The workstation includes a table top, a legs assembly mounted below the table top, a base frame mounted to the legs assembly, and an adjustment mechanism configured to move the legs assembly to adjust the height of the table top relative to the base frame. The adjustment mechanism can include a gas spring and an actuator. A user can actuate the actuator to adjust the height of the table top. The gas spring can provide force, which aids the user in raising or lowering the table top.

8 Claims, 13 Drawing Sheets

(56) References Cited

U.S. PATENT DOCUMENTS

| | | | | |
|---|---|---|---|---|
| 2014/0041554 | A1* | 2/2014 | Huang | A47B 9/16 108/50.11 |
| 2014/0144352 | A1* | 5/2014 | Roberts | A47B 21/0314 108/96 |
| 2017/0354245 | A1* | 12/2017 | Martin | A47B 21/02 |
| 2018/0255919 | A1* | 9/2018 | Swartz | A47B 9/02 |

* cited by examiner

HEIGHT ADJUSTABLE WORKSTATION

INCORPORATION BY REFERENCE TO ANY PRIORITY APPLICATIONS

This application claims priority to U.S. Provisional Patent Application No. 62/426,650, filed Nov. 28, 2016, and U.S. Provisional Patent Application No. 62/458,147, filed Feb. 13, 2017, each of which are incorporated herein by reference. Any and all applications for which a foreign or domestic priority claim is identified in the Application Data Sheet as filed with the present application are hereby incorporated by reference under 37 CFR 1.57.

BACKGROUND

Field

This application relates generally to workstations, such as desks, and more particularly, to height adjustable workstations.

Description

Increasingly, people spend large portions of their day at workstations, such as desks, in a seated position. Sitting for long periods of time may have adverse health consequences. For example, some studies have shown that sitting for extended periods may increase risks associated with cardiovascular disease, diabetes, and obesity.

Many believe that periodically standing during the work day can improve one's health. For example, standing can potentially burn more calories than sitting and result in weight loss and/or provide improved posture. Additionally, some find that it is easier to remain focused at work when standing.

SUMMARY

This application describes height adjustable workstations. The height adjustable workstations can include adjustment mechanisms that are configured to allow a user to adjust, set, or select the height of the workstation so that the workstation can be used in a standing position or a seated position as desired.

In a first aspect, an adjustable workstation is described. The workstation can include a table top having an upper side and an opposed underside. The workstation can include a legs assembly comprising at least one scissor mechanism including a first leg and a second leg. A top of the first leg can be pivotally attached to the underside of the table top, and a top of the second leg can be slidingly engaged with a groove attached to the underside of the table top. The workstation can also include a base frame. A bottom of the first leg can be slidingly engaged with a groove on the base frame, and a bottom of the second leg can be pivotally attached to the base frame. The workstation can also include an adjustment mechanism configured to move the legs assembly to adjust a height of the table top relative to the base frame. The adjustment mechanism can include a gas spring comprising a cylinder, a piston rod, and a valve. A free end of the piston rod can be attached to the underside of the table top by a bracket. The adjustment mechanism can also include a carrier tray slidingly engaged with a slot attached to the underside of the table. The cylinder can be mounted in the carrier tray. The carrier tray can be configured to allow the cylinder to move back and forth along the slot as the gas spring compresses or expands. The carrier tray may be attached to the top of the second leg such that the carrier tray and the top of the second leg slide move together. The actuator mechanism also includes an actuator configured to actuate the valve, the actuator comprising an actuator handle positioned on an edge of the table top. In some embodiments, upon actuation of the valve, the height of the table top relative to the base frame is adjustable, and upon release of the valve, the height of the table top relative to the base frame remains fixed.

In some embodiments, the actuator comprises: an actuator arm extending from the actuator handle, the actuator arm extending under a bracket mounted to the underside of the table top; an actuator post projecting from the actuator arm; a pivot arm pivotally attached to the bracket and positioned between the actuator post and the valve. In some embodiments, the actuator handle is configured to be pressed toward the valve to cause the actuator post to rotate the pivot arm into the valve to actuate the valve. In some embodiments, the legs assembly comprises a second scissor mechanism including a first leg and a second leg, a top of the first leg pivotally attached to the underside of the table top, a top of the second leg slidingly engaged with a groove attached to the underside of the table top. In some embodiments, the workstation further includes a locking actuator, wherein the locking actuator comprises: an actuator handle positioned on an edge of the table top; an actuator arm extending from the actuator handle, the actuator arm extending under a bracket mounted to the underside of the table top; and a catch projecting from the actuator arm. In some embodiments, the catch is configured to engage with a latch positioned on the base frame when the table top is lowered to the base frame. In some embodiments, the actuator and the locking actuator are positioned on opposite edges of the table top. In some embodiments, the adjustment mechanism further comprises a spring extending between the carrier tray and a bracket on the underside of the table top, the spring configured to bias the carrier tray such that the gas spring is in an uncompressed position. In some embodiments, the workstation further includes a leaf spring mounted to the underside of the table, wherein the leg assembly compresses the leaf spring when the table top is lowered to the base frame. In some embodiments, the adjustment mechanism is configured for stepless adjustment of the height of the table top.

In a second aspect, another adjustable workstation is described. The workstation can include a table top having an upper side and an opposed underside. The workstation can includes a legs assembly comprising at least a first scissor mechanism including a first leg and a second leg. A top of the first leg can be pivotally attached to the underside of the table top, and a top of the second leg can be slidingly engaged with a groove attached to the underside of the table top. The workstation can include a base frame. A bottom of the first leg can include comprising a roller engaged with a roller tray on the base frame, and a bottom of the second leg can be pivotally attached to the base frame. The workstation can include an adjustment mechanism configured to move the legs assembly to adjust a height of the table top relative to the base frame. The adjustment mechanism can include a rack and pinion mechanism comprising a first rack engaged with a pinion gear. The first rack can be mounted on a slide such that the first rack can move back and forth along the slide as the pinion gear rotates. The adjustment mechanism can include a first locking mechanism, comprising a spring loaded locking pawl configured to engage the first rack to prevent movement of the first rack. The adjustment mechanism can include a gas spring comprising a cylinder and a piston rod, wherein a free end of the piston rod is attached to the underside of the table, and an end of the cylinder is attached to the first rack. The adjustment mechanism can include a first actuator configured to release the locking pawl to allow the first rack to move. In some embodiments, upon actuation of the actuator, the height of the table top relative to the base frame is adjustable, and upon release of the actuator, the height of the table top relative to the base frame remains fixed.

In some embodiments, the adjustment mechanism further comprises: a second rack engaged with the pinion gear, the second rack mounted on a slide such that the second rack can move back and forth along the slide as the pinion gear rotates, a second locking mechanism, comprising a spring loaded locking pawl configured to engage the second rack to prevent movement of the second rack, a spring extending between the second rack and a bracket mounted on the underside of the table, and a second actuator configured to release the locking pawl to allow the second rack to move. In some embodiments, both the first actuator and the second actuator must be actuated to adjust the height of the table top. In some embodiments, the legs assembly further comprises a second scissor mechanism including a first leg and a second leg, a top of the first leg pivotally attached to the underside of the table top, a top of the second leg slidingly engaged with a groove attached to the underside of the table top. In some embodiments, the first and second scissor mechanisms are staggered. In some embodiments, the roller tray of the first scissor mechanism and the roller tray of the second scissor mechanism are located in opposite corners of the base frame. In some embodiments, the first actuator comprises: an actuator handle; an actuator arm extending from the actuator handle below a bracket mounted to the underside of the table; an angled surface formed in the actuator arm; and a housing having an angled surface configured to ride on the actuator surface of the actuator arm, the locking pawl connected to the actuator housing. In some embodiments, the actuator handle comprises a cup like handle extending through an opening in the table top. In some embodiments, the first actuator is configured to be actuated by pulling the cup actuator handle outwardly.

In a third aspect, a method for adjusting the height of an adjustable workstation is described. The method can include actuating an actuator to lower a table top of the workstation; storing energy in a gas spring as the table top is lowered; and actuating the actuator to raise the table top the workstation, wherein energy stored in the gas spring is used to assist a user in raising the table top.

In some embodiments, actuating the actuator comprises depressing an actuator handle to open a valve of the gas spring. In some embodiments, actuating the actuator comprises pulling an actuator handle to release a locking pawl from a rack of a rack and pinion mechanism.

BRIEF DESCRIPTION OF THE DRAWINGS

The features and advantages of the height adjustable workstations and associated methods described herein will become more fully apparent from the following description and appended claims, taken in conjunction with the accompanying drawings. These drawings depict only several embodiments in accordance with the disclosure and are not to be considered limiting of its scope. In the drawings, similar reference numbers or symbols typically identify similar components, unless context dictates otherwise. The drawings may not be drawn to scale.

DETAILED DESCRIPTION

This application describes height adjustable workstations. The following discussion presents detailed descriptions of several embodiments. These embodiments are not intended to be limiting, and modifications, variations, combinations, etc., are possible and within the scope of this disclosure.

The height adjustable workstations can include adjustment mechanisms that are configured to allow a user to adjust, set, or select the height of the workstation so that the workstation can be used in a standing position or a seated position as desired. The adjustment mechanisms can include one or more gas springs configured to assist the user in raising or lowering the height of the workstation. The gas spring can provide force that raises or lowers the workstation, such that the user needs to apply little to no force to adjust the height of the workstation. In some embodiments, the gas spring can be supplemented with one or more mechanical springs (e.g., coil springs).

The height adjustable workstations can include one or more actuators configured to allow a user to actuate the adjustment mechanisms. The actuators can be, for example, buttons or handles. The actuators can be positioned in various locations on the height adjustable workstations. In some embodiments, the actuators are buttons positioned on the periphery (e.g., along the edges) of the workstation that are actuated (e.g., pressed) to operate the adjustment mechanism. In some embodiments, the actuators are handles that extend through a surface of the workstation (e.g., in our through openings in the surface of the workstation) that are actuated (e.g., pulled outwardly) to operate the adjustment mechanism. Other locations and methods of actuation for the actuators are also possible.

The adjustment mechanisms may also be configured to lock the height of the workstation in place. For example, when a user actuates the actuators, the user can easily adjust the height of the workstation, and when the user releases the actuators, the height of the workstation can be locked into place. In some embodiments, the adjustment mechanism is configured for stepless adjustment, allowing a user to select any height. In some embodiments, the adjustment mechanism is configured for stepped adjustment, allowing the user to select, any of a plurality of incremental heights for the workstation.

These and other features and advantages of the height adjustable workstations, as well as associated methods of use and manufacture, will now be described in greater detail with reference to the several embodiments illustrated in the figures. The embodiments illustrated in the figures are provided by way of example and should not be construed so as to limit this disclosure to only the illustrated embodiments.

Figure 1A:
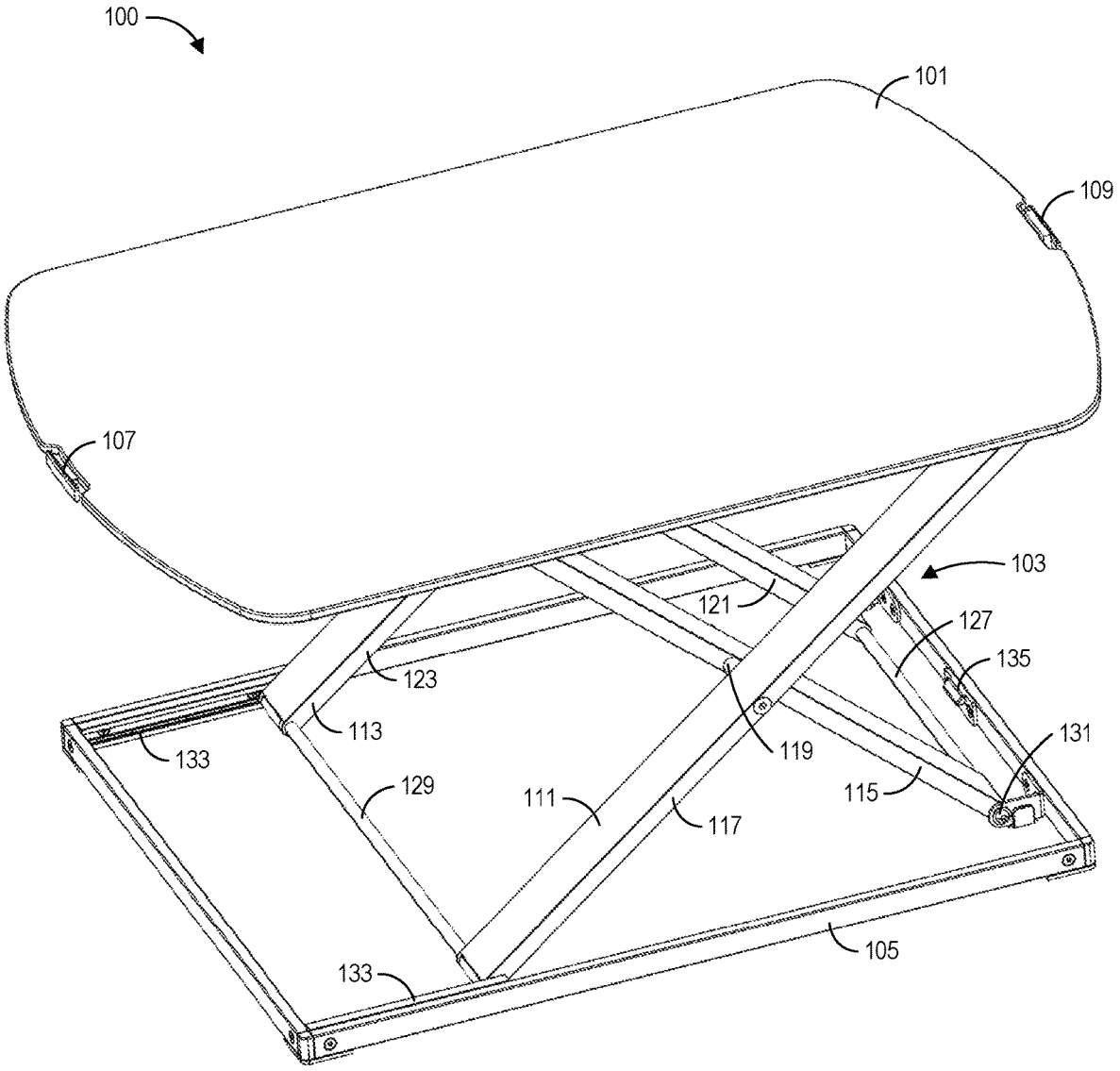
FIG. 1A is a top isometric view of a first embodiment of a height adjustable workstation.
Figure 1B:
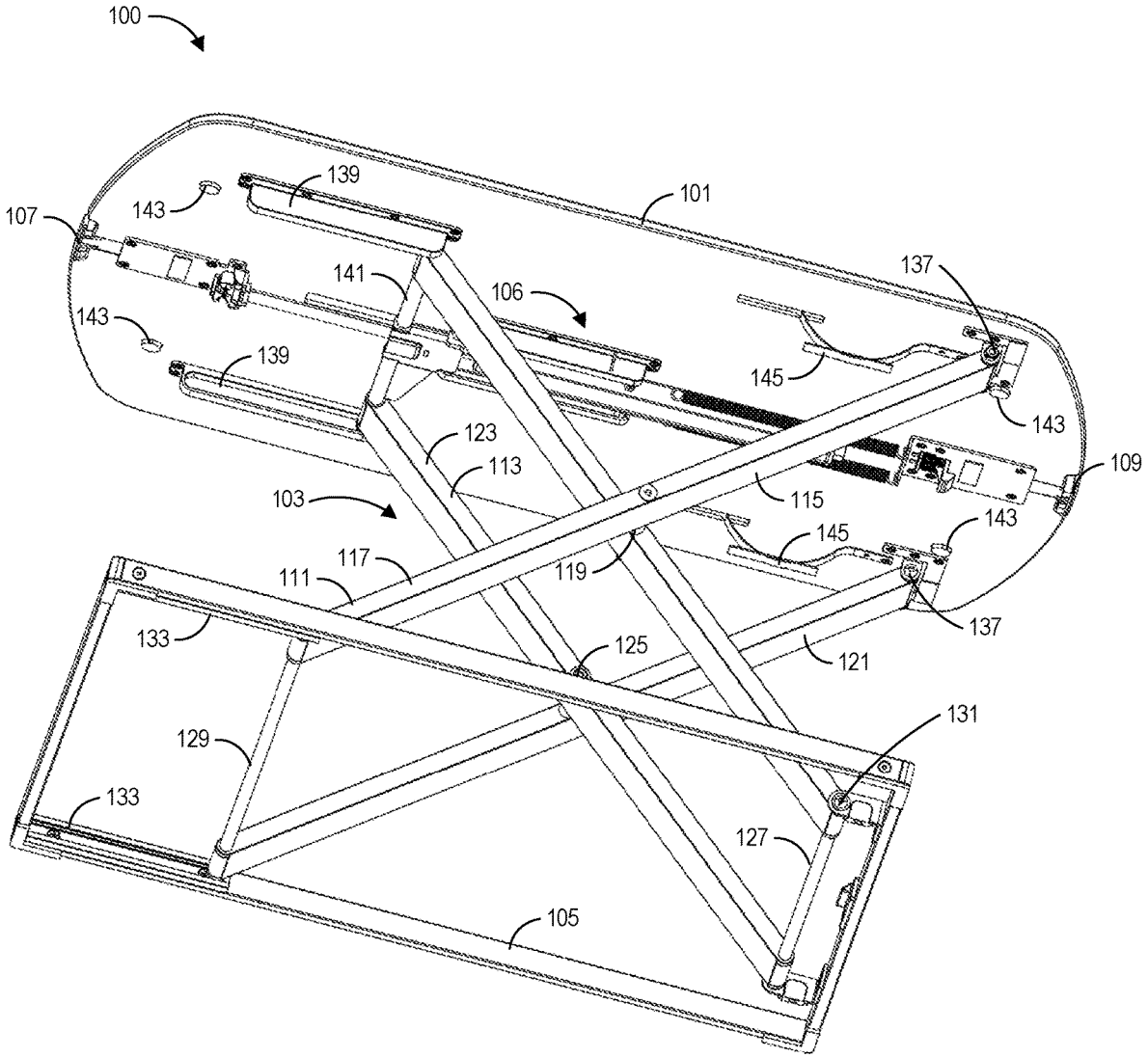
FIG. 1B is a bottom isometric view of the height adjustable workstation of FIG. 1A.

FIGS. 1A and 1B are top and bottom isometric views of a first embodiment of a height adjustable workstation 100. The workstation 100 includes a table top 101, a leg assembly 103, a base frame 105, and an adjustment mechanism 106. As will be described in greater detail below, the adjustment mechanism 106 can be actuable to adjust the height of the table top 101 relative to the base frame 105.

The table top 101 can comprise a generally planar surface. In use, a user may place items on the table top 101. The table top 101 can comprise any peripheral shape, such as rectangular, square, oval, etc. In the illustrated embodiment, the table top 101 comprises a generally rectangular shape with rounded right and left edges. Any shape for the table top 101 is possible.

As illustrated in FIG. 1A, for some embodiments, the workstation 100 includes a first actuator 107 and a second actuator 109. As will be described in greater detail below, one or both of these actuators 107, 109 can be operated to adjust the height of the table top 101 relative to the base frame 105 and/or lock the height of the table top 101 in position. In the illustrated embodiment, the first actuator 107 is positioned on the left edge of the table top 101 and the second actuator 109 is positioned on right edge of the table top 101. Other locations for the actuators 107, 109 are also possible. In the illustrated embodiment, of FIGS. 1A-1E, the actuators comprise paddle-like buttons that can be pressed inwardly to actuate the adjustment mechanism 106. This will be described in greater detail below. In some embodiments, the two actuators 107, 109, may be replaced with a single actuator.

In the illustrated embodiment, the second actuator 109 is configured to engage with a latch 135 on the base frame 105 when the table top 101 is completely lowered toward the base frame 105. This may lock the table top 101 to the base frame 105 for storage or transport, for example. In the illustrated embodiment, the latch 135 can be released (allowing the table top 101 to rise) by pressing on the second actuator 109. This is described in greater detail below with reference to FIG. 1E. In some embodiments, the latch 135 may be positioned to engage the first actuator 107.

The table top 101 is mounted on the leg assembly 103. The leg assembly 103 can support the table top 101. The table top 101 may be supported in a generally horizontal position. In some embodiments, the table top 101 maintains a generally horizontal position as it is adjusted up and down. This may advantageously allow adjustment without requiring the table top 101 to be emptied before adjustment.

The leg assembly 103 can comprise a first scissor mechanism 111 and a second scissor mechanism 113. The first scissor mechanism 111 can comprise a first leg 115 and a second leg 117. The first leg 115 and the second leg 117 can be joined by a pivot 119. In some embodiments, the pivot 119 includes a torsion element, such as a spring (not illustrated). The first scissor mechanism 111 can be positioned toward a front side of the workstation 100. The second scissor mechanism 113 can comprise a first leg 121 and a second leg 123. The first leg 121 and the second leg 123 can be joined by a pivot 125 (see FIG. 1B). In some embodiments, the pivot 125 includes a torsion element, such as a spring (not illustrated). The second scissor mechanism 113 can be positioned toward a back side of the workstation 100, for example, opposite the first scissor mechanism 111.

The angle (measured at the pivot) between the first and second legs of the first and second scissor mechanisms 111, 113 can be varied or adjusted to adjust the height of the leg assembly 103 and the table top 101. For example, as the angle between the first and second legs goes to zero the table top 101 is lowered toward the base frame 105. As the angle between the first and second legs increases, the table top 101 is raised away from the base frame 105.

In the illustrated embodiment, the first and second scissor mechanisms 111, 113 are connected at their lower ends by a first cross piece 127 and a second cross piece 129. The first cross piece 127 can be positioned towards a right edge of the workstation 100. The second cross piece 129 can be positioned towards a left edge of the workstation 100. The first and second cross pieces 127, 129 can be configured to link the first and second scissor mechanisms 111, 113 such that the first and second scissor mechanisms 111, 113 move together. In some embodiments, the angle may begin to close again as the table top 101 continues to rise.

The first cross piece 127 can be fixed by a pivot 131 to the base frame 105. The pivot 131 can allow the lower right portions of the first and second scissor mechanisms 111, 113 to pivot or rotate relative to the base frame 105. In some embodiments, the pivot 131 includes a torsion element, such as a spring (not illustrated). The second cross piece 129 can be slidingly engaged with grooves 133 on base frame 105. The grooves 133 can allow the second cross piece 129 to slide along the base frame 105 to allow the first and second scissor mechanisms 111, 113 to be adjusted up and down. For example, as the workstation 100 is lowered from the position shown in FIG. 1A, the second cross piece 129 and lower left legs of the first and second scissor mechanisms 111, 113 can slide along the grooves 133 towards the left edge of the base frame 105.

As shown in FIG. 1B, for some embodiments, one side of the first and second scissor mechanisms 111, 113 (e.g., the right side as illustrated) can be attached to the underside of the table top 101 by pivots 137. The pivots 137 can allow the upper right portions of the first and second scissor mechanisms 111, 113 to pivot or rotate relative to the table top 101. In some embodiments, the pivots 137 include a torsion element, such as a spring (not illustrated). The opposite side of the first and second scissor mechanisms 111, 113 (e.g., the left side as illustrated) can be slidingly engaged with the underside of the table top 101 with slots 139. Similar to the grooves 133 described above, the slots 139 can allow the first and second scissor mechanisms 111, 113 to be adjusted above and down. For example, as the workstation 100 is lowered from the position shown in FIG. 1B, the upper left legs of the first and second scissor mechanisms 111, 113 can slide along the slots 139 towards the left edge of the table top 101. In the illustrated embodiment, the upper left legs of the first and second scissor mechanisms 111, 113 are joined by a cross piece 141.

In some embodiments, the underside of the table top 101 can include one or more additional features as illustrated. For example, bumpers 143 can be positioned on the underside of the table top 101. The bumpers 143 can be formed of a rubberized material, for example. The bumpers 143 can be positioned to contact the base frame 105 when the table top 101 is completely lowered onto the base frame 105. Springs 145, such as the illustrated leaf springs, can also be positioned on the underside of the table top 101. The springs 145 can be positioned to cushion the table top 101 as it is lowered all the way to the base frame 105 and/or to provide additional force for lifting the table top 101 away from the base frame 105 from the completely lowered position. The springs 145 can be positioned to contact either the legs of the first and second scissor mechanisms 111, 113 and/or the base frame 105.

As shown, the adjustment mechanism 106 may also be positioned on the bottom surface of the table top 101. The adjustment mechanism 106 will be described in detail below with reference to FIGS. 1C-1E. The adjustment mechanism 106 can act on the first and second scissor mechanisms 111, 113 to adjust the height of the table top 101 relative to the base frame 105.

The base frame 105 is illustrated in FIGS. 1A and 1B. As illustrated, for some embodiments, the base frame 105 comprises a generally rectangular frame structure. The frame structure can comprise other shapes. The base frame 105 can be made from a single piece (i.e., a unitary construction) or multiple pieces joined together (e.g., by adhesives, welding, fasteners, etc.) As described above, the lower ends of the first and second scissor mechanisms 111, 113 are attached to the base frame 105. In some embodiments, when the table top 101 is completely lowered, the table top 101 rests substantially on top of (e.g., contacts) the top of the base frame 105. In some embodiments, in the lowered position, the first and second scissor mechanisms 111, 113 can collapse such that they are positioned within base frame 105 (i.e., received within the opening created by the generally rectangular frame structure). This can provide that, when lowered, the workstation 100 is substantially thin. For example, in the lowered configuration, the workstation 100 can be less than 5 inches thick, less than 4 inches thick, less than 3 inches thick, less than 2 inches thick, or less than 1 inch thick.

The base frame 105 is configured to support the workstation 100. In some embodiments, the base frame 105 is configured to be placed on the surface of a conventional workstation, such as a desk. The table top 101 can then be raised or lowered relative to the base frame 105 to provide an adjustable workstation surface above the conventional desk. This can convert a traditional workstation into an adjustable workstation. In some embodiments, the base frame 105 is configured to be placed on the floor and the workstation is adjustable from heights which would permit use by a seated user to heights that would permit use by a standing user.

Figure 1C:
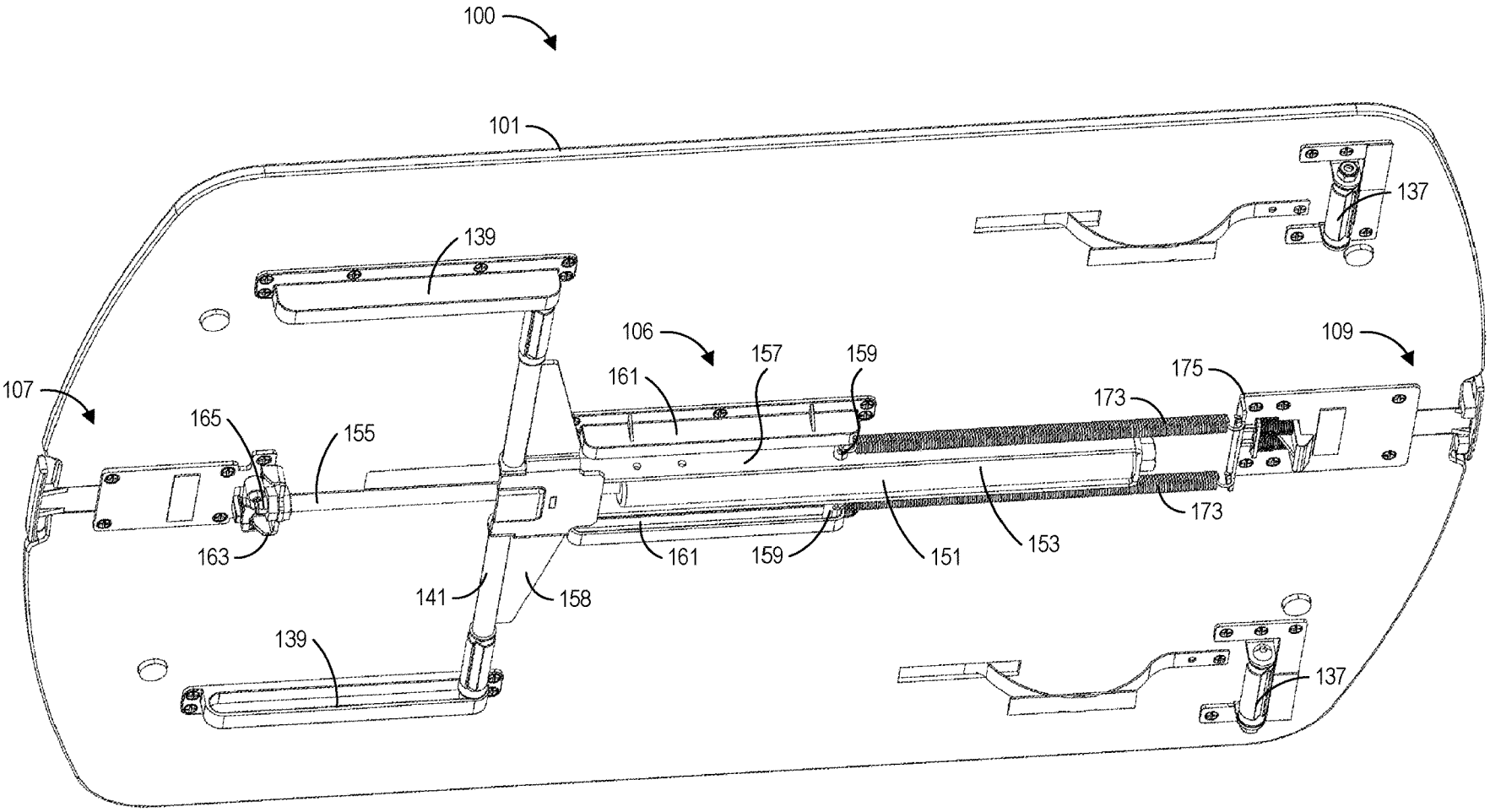
FIG. 1C is a bottom isometric view of the height adjustable workstation of FIG. 1A shown with legs removed to illustrate an embodiment of an adjustment mechanism thereof.
Figure 1D:
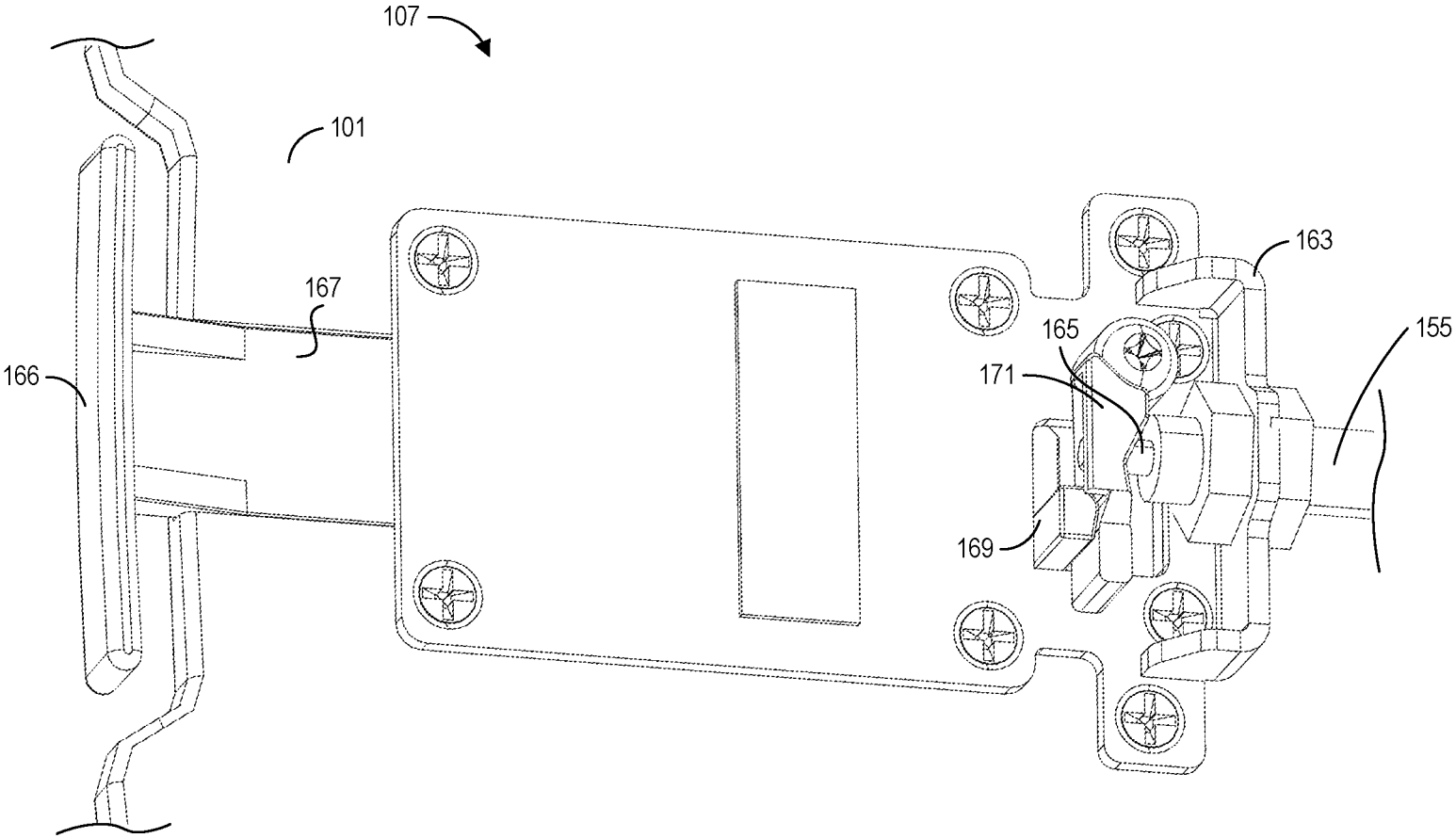
FIG. 1D is a detail view of a first actuator of the adjustment mechanism of FIG. 1C.
Figure 1E:
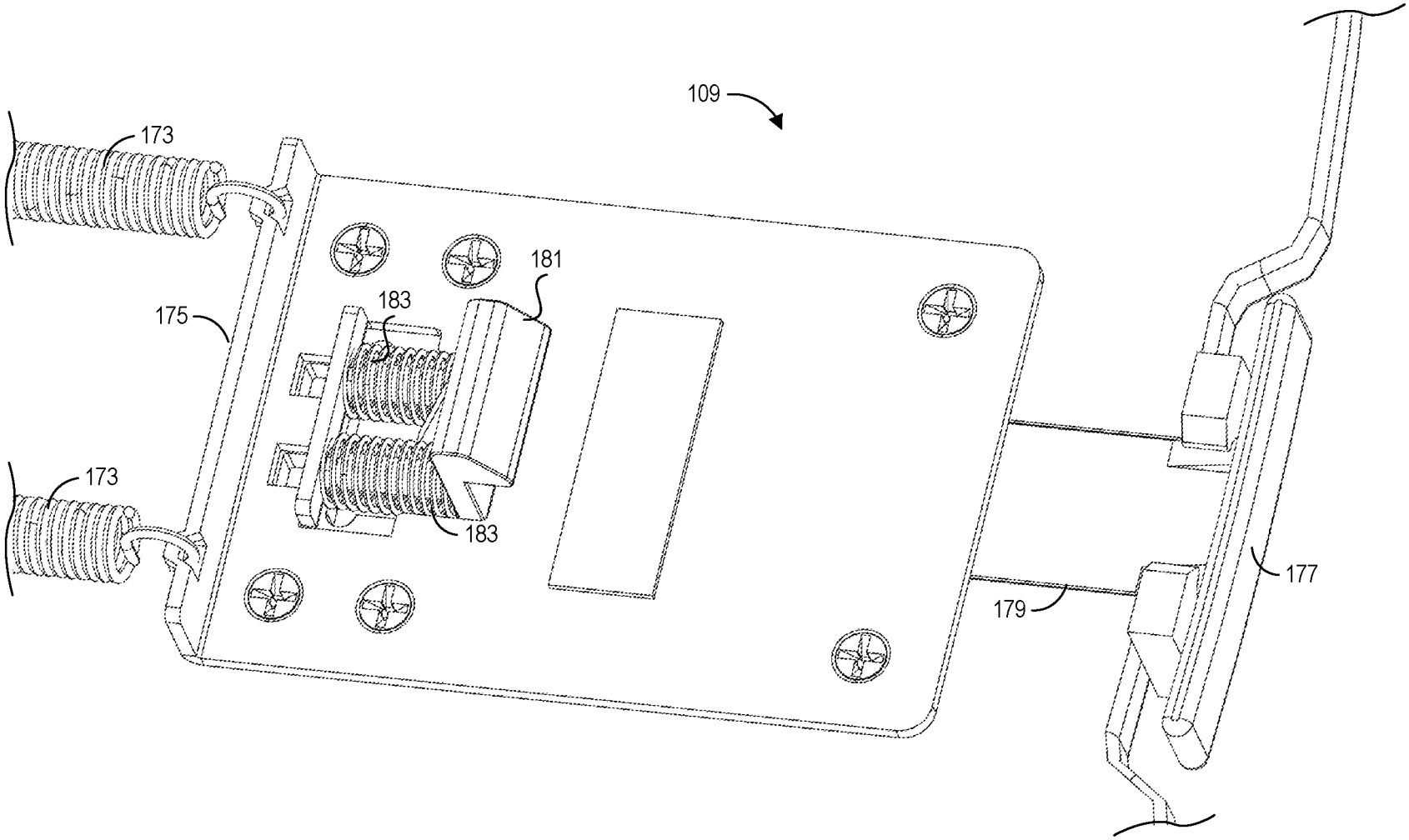
FIG. 1E is a detail view of a second actuator of the adjustment mechanism of FIG. 1C.

Turning now to FIGS. 1C-1E, an embodiment of the adjustment mechanism 106 of the workstation 100 is shown in greater detail. FIG. 1C is a bottom isometric view of the height adjustable workstation 100 shown with legs removed to illustrate the adjustment mechanism 106 thereof. FIG. 1D is a detail view of the first actuator 107 of the adjustment mechanism 106, and FIG. 1E is a detail view of the second actuator 109 of the adjustment mechanism 106. As mentioned previously, the adjustment mechanism 106 is actuable to permit adjustment of the height of the table top 101 relative to the base frame 105.

As illustrated, for some embodiments, the adjustment mechanism 106 includes a gas spring 151. The gas spring 151 can include a cylinder 153 and a piston rod 155. The gas spring 151 can use compressed gas contained within the cylinder 153 to pneumatically store potential energy and withstand external force applied to the piston rod 155. The stored potential energy 153 can be released to permit the gas spring 151 to provide a force with the piston rod 155. Many types of gas springs 151 can be used as apparent to those of ordinary skill in the art upon consideration of this disclosure. In some embodiments, only a single gas spring 151 is used. In some embodiments, multiple gas springs 151 can be used. As will be described below, the gas spring 151 can supply force to aid a user in raising and lowering the workstation 100.

As shown in FIG. 1C, for some embodiments, the cylinder 153 of the gas spring 151 can be mounted in a carrier tray 157. The carrier tray 157 can be a bracket configured to hold the cylinder 153. The carrier tray 157 can partially or wholly surround the cylinder 153. In the illustrated embodiments, pins 159 extend laterally away from the sides of the carrier tray 157. The pins 159 can be received in slots 161. The slots 161 can be attached to the underside of the table top 101. The pins 159 can slidingly engage the slots 161, such that the pins 159 can move through (i.e., back and forth within) the slots 161. Because the slots 161 extend from the carrier tray 157, the engagement between the pins 159 and slots 161 can permit the carrier tray 157 to move back and forth (e.g., along an axis of the cylinder 153) relative to the slots 161 the table top 101. Thus, in some embodiments, the cylinder 153 is slidingly engaged with the table top 101 via the carrier tray 157, pins 159, and slots 161.

The free end of the piston rod 155 (i.e., the end not within the cylinder 153) can be mounted to a bracket 163 as shown. In the illustrated embodiment, the bracket 163 forms part of the first actuator 107. The bracket 163 can be fixedly attached to the underside of the table top 101. Thus, in some embodiments, the free end of the piston rod 155 is fixed to the table top 101 via the bracket 163.

Because the cylinder 153 can be slidingly engaged with the table top 101 and the piston rod 155 is fixedly attached to the table top 101, the gas spring 151 can be compressed by sliding the cylinder 153 toward the free end of the piston rod 155. When the gas spring 151 is released, the gas spring can provide a force as the cylinder 153 moves back away from the free end of the piston rod 155. As shown in FIG. 1C, the free end of the piston rod 155 can include a valve 165 that can be actuated (e.g., opened) to release the gas spring 151. When the valve 165 is actuated, the user can easily move the table top 101 up and down to any desired height. When the valve 165 is released, the height of the table top 101 may be substantially locked in place. This mechanism can allow for stepless height adjustment of the workstation 100. The valve 165 can be actuated using the first actuator 107.

The first actuator 107 is shown in the detail view of FIG. 1D. In the illustrated embodiment, the first actuator 107 comprises an actuator handle 166, an actuator arm 167, an actuator post 169, and a pivot arm 171. The actuator handle 166 can be attached to the actuator arm 167. The actuator arm 167 can extend below the bracket 163, which is attached to the underside of the table top 101. In some embodiments, the underside of the table top 101 includes a groove below the bracket 163 to accommodate the actuator arm 167. Opposite the actuator handle 166, an actuator post 169 extends outwardly from the actuator arm 167. The actuator post 169 can be positioned to contact the pivot arm 171. The pivot arm 171 can be pivotally (e.g., rotationally) attached to the bracket 163. The pivot arm 171 can contact the valve 165 of the gas spring 151.

In some embodiments, the first actuator 107 can be actuated by pressing the actuator handle 166 inwardly. This can cause the actuator arm 167 to slide below the bracket 163 moving the actuator post 169 inwardly. The inward motion of the actuator post 169 can cause the pivot arm 171 to rotate inwardly and open the valve 165. Thus, by compressing the actuator handle 166 inwardly, the valve 165 of the gas spring 151 can be opened allowing the height of the table top 101 to be adjusted. To close the valve, a user may simply release the actuator handle 166, locking the height of the table top 101 substantially in place.

Returning to FIG. 1C, the actuation mechanism 106 can additionally include mechanical springs 173, such as the coil springs illustrated. The springs 173 can extend between the carrier tray 157 and a bracket 175. The bracket 175 may form part of the second actuator 109, described below with reference to FIG. 1E. In some embodiments, the springs 173 extend between the pins 159 and the bracket 175. The springs 173 can provide a force that pulls the carrier tray 157 (and the cylinder 153 of the gas spring 151) towards one side (e.g., the left side in the figure) of the workstation 101. Thus, the springs 173 can provide a force that pulls the gas spring 153 towards its uncompressed state. In some embodiments, a single spring 173 can be used. In some embodiments, multiple springs 173 can be used. In some embodiments, the springs 173 can be omitted.

With reference to FIGS. 1C and 1D, the actuation mechanism 106 may operate as follows. To move the workstation 100 from an elevated positon (e.g., as shown in FIGS. 1A and 1B) to a lowered position, a user may depress the actuator handle 166 of the first actuator 107, opening the valve 165 of the gas spring 151. With valve 165 open, the piston rod 155 may be free to move within the cylinder 153. The weight of objects on the table top 101 and/or a force applied by the user can then be used to lower the table top 101 toward the base frame 105. As the table top 101 moves down, the carrier tray 157 and cylinder 153 move toward the first actuator 107. The carrier tray 157 can be attached to the cross piece 141 of the first and second scissor mechanisms 111, 113 by a bracket 158 (see FIG. 1C). Thus, as the carrier tray 157 moves forward, the cross piece 141 slides within the slots 139 allowing the first and second scissor mechanisms 111, 113 to close as described above.

The gas spring 151 may provide a dampening effect to help control the descent of the table top 101. Additionally, as the table top 101 descends, the springs 173 are stretched, providing a resistive force that further controls the descent of the table top 101. This can allow the user to control the descent of the table top 101 in a simple manor that requires little human force. To set the height of the table top 101, the user need only release the actuator handle 165.

To move the workstation 100 from a lowered position to an elevated position, a user may again depress the actuator handle 166 of the first actuator 107, opening the valve 165 of the gas spring 151. With valve 165 open, the piston rod 155 may be free to move within the cylinder 153. Because the gas spring 151 is in a compressed position when the table top 101 is lowered, the gas spring 151 may provide a force that raises the table top 101. The force from the gas spring 151 may be supplemented by the force provided by the springs 173 and/or an additional force provided by the user. As the table top 101 moves up, the carrier tray 157 and cylinder 153 move away from the first actuator 107. As the carrier tray 157 moves away, the cross piece 141 slides within the slots 139 allowing the first and second scissor mechanisms 111, 113 to open as described above. Again, to set the height of the table top 101, the user need only release the actuator handle 165.

The actuator mechanism 106 thus can be configured to permit simple adjustment of the height of the workstation 100. Adjusting the strength of the gas spring 151 and/or springs 173 can permit balancing such that minimal human force is required to raise or lower the workstation 100. In some embodiments, raising or lowering the workstation 100 requires less than 15 pounds of force, less than 10 pounds of force, less than 5 pounds of force, or less than 2.5 pounds of force. In some embodiments, the workstation is adjustable up to 8 inches, 12 inches, 16 inches, 20 inches, 24 inches, 28 inches, 32 inches, 36 inches, 40 inches, 44 inches, 48 inches, or higher. In some embodiments, the workstation can support at least 10 pounds, at least 20 pounds, at least 25 pounds, at least 30 pounds, at least 35 pounds, at least 40 pounds, or at least 50 pounds, or more.

FIG. 1E is a detail view of the second actuator 109 of the adjustment mechanism 106. The second actuator 109 can be configured to lock the table top 101 to the base frame 105 in the fully lowered configuration. As illustrated, for some embodiments, the second actuator 109 includes an actuator handle 177, an actuator arm 179, a catch 181, and springs 183. The actuator handle 177 can be attached to the actuator arm 179. The actuator arm 179 can extend below the bracket 175, which is attached to the underside of the table top 101. In some embodiments, the underside of the table top 101 includes a groove below the bracket 175 to accommodate the actuator arm 177. Opposite the actuator handle 177, a catch 181 extends from actuator arm 179. The catch 181 is configured to engage with the latch 135 (see FIG. 1A) when the workstation is fully lowered. Springs 183 are provided to bias the catch 181 to the closed position. A user can release the catch 181 by depressing the actuator handle 177, overcoming the bias of the springs 183.

Figure 2A:
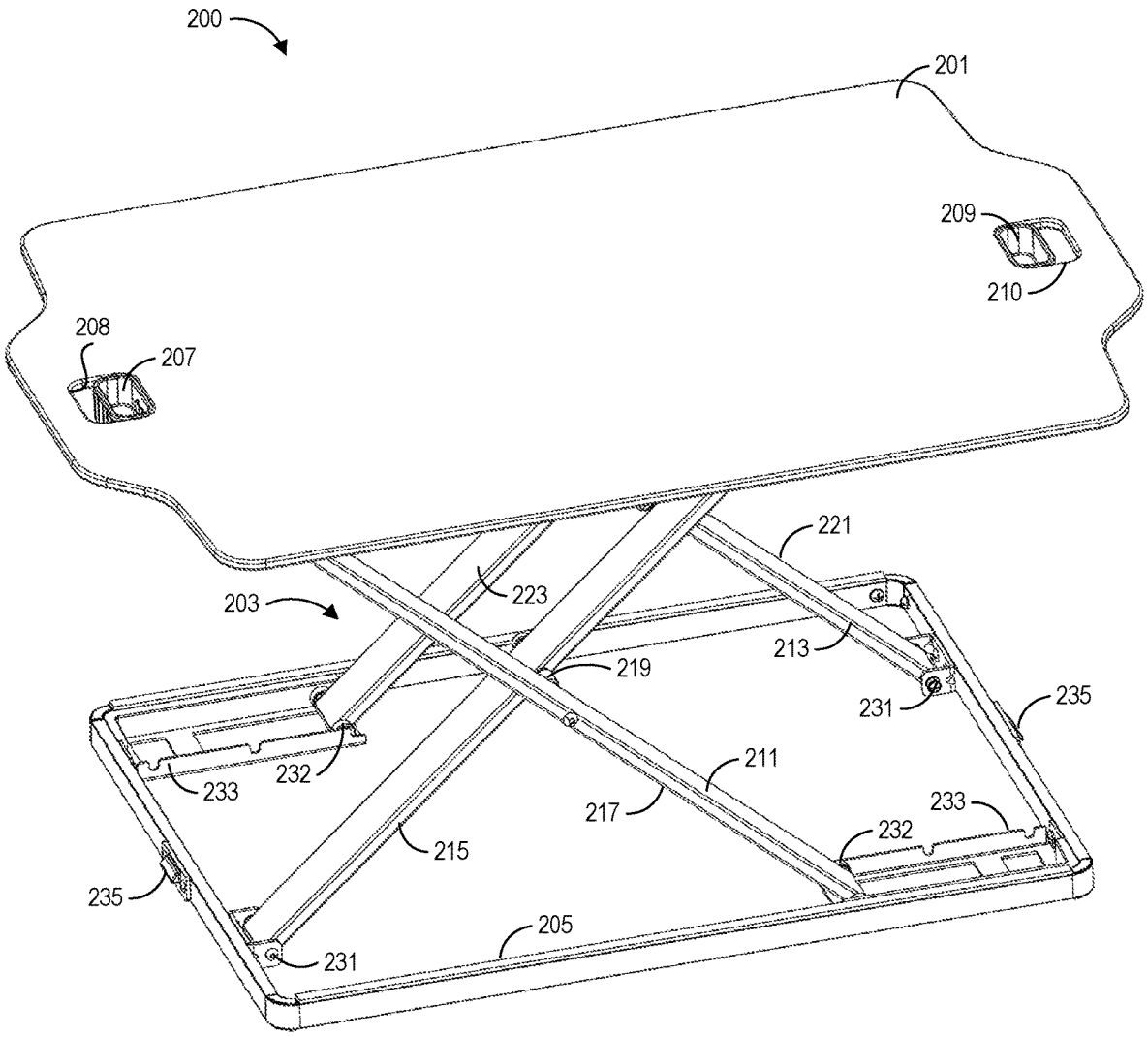
FIG. 2A is a top isometric view of a second embodiment of a height adjustable workstation.
Figure 2B:
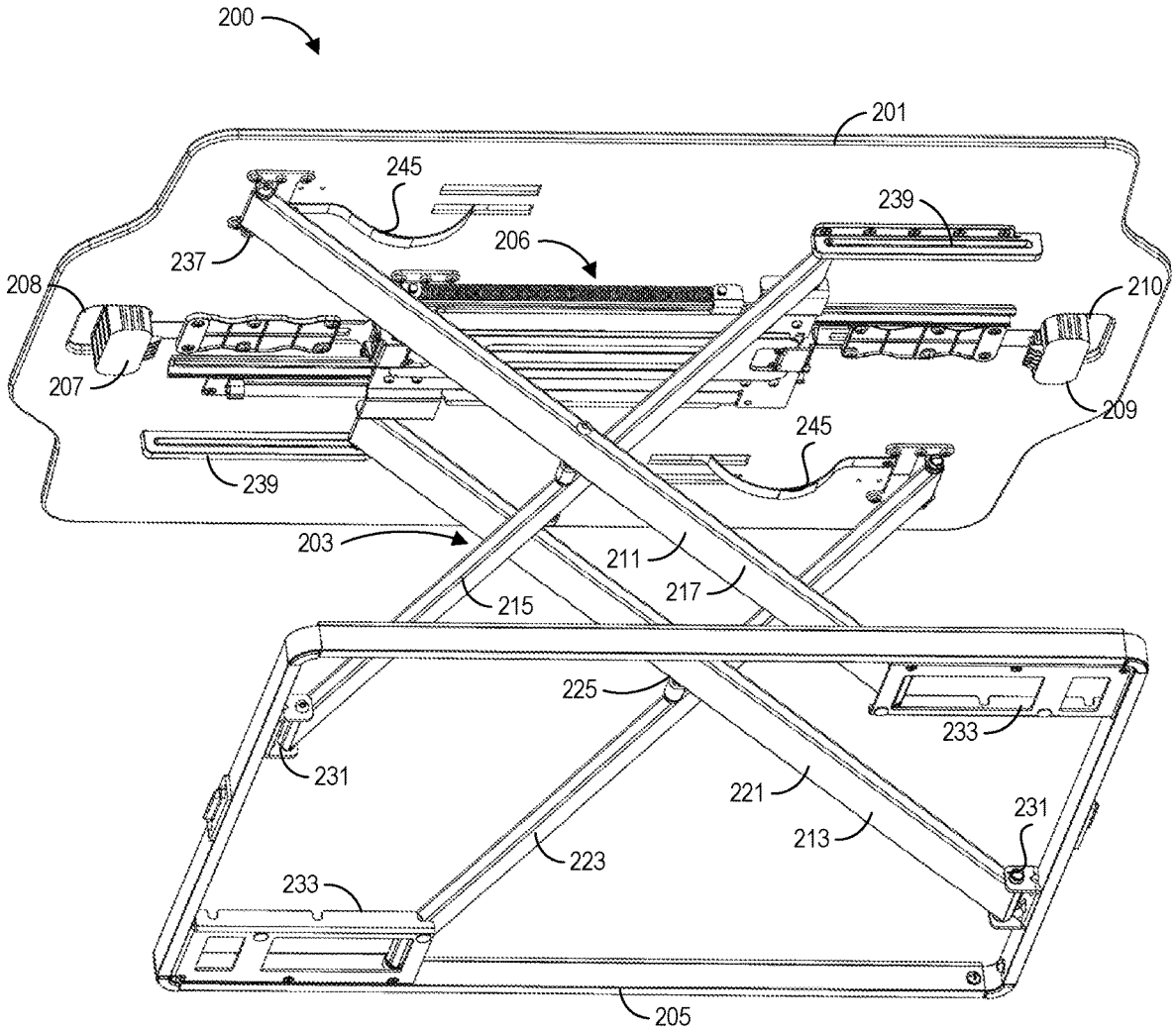
FIG. 2B is a bottom isometric view of the height adjustable workstation of FIG. 2A.

FIGS. 2A and 2B are top and bottom isometric views of a second embodiment of a height adjustable workstation 200. The workstation 200 includes a table top 201, a leg assembly 203, a base frame 205, and an adjustment mechanism 206. As will be described in greater detail below, the adjustment mechanism 206 can be actuable to adjust the height of the table top 201 relative to the base frame 205.

The table top 201 can comprise a generally planar surface. In use, a user may place items on the table top 201. The table top 201 can comprise any peripheral shape, such as rectangular, square, oval, etc. In the illustrated embodiment, the table top 201 comprises a generally rectangular shape with right and left edges that include a tabbed shape. Any shape for the table top 201 is possible.

As illustrated in FIG. 2A, for some embodiments, the workstation 200 includes a first actuator 207 and a second actuator 209. As will be described in greater detail below, one or both of these actuators 207, 209 can be operated to adjust the height of the table top 201 relative to the base frame 205 and/or lock the height of the table top 201 in position. In the illustrated embodiment, the first actuator 207 is positioned within an opening 208 extending through a left portion (relative to the orientation shown in the figure) of the table top 201, and the second actuator 209 is positioned in an opening 210 extending through a right portion of the table top 201. Other locations for the actuators 207, 209 are also possible (e.g., through variously positioned openings or along the edges of the table top). In the illustrated embodiment, of FIGS. 2A-2G, the actuators 207, 209 comprise cup-like handles that can be pulled outwardly to actuate the adjustment mechanism 206. This will be described in greater detail below. In some embodiments, the two actuators 207, 209, may be replaced with a single actuator.

In the illustrated embodiment, the first and second actuators 207, 209 are configured to engage with latches 235 on the base frame 205 when the table top 201 is completely lowered toward the base frame 205. This may lock the table top 201 to the base frame 205 for storage or transport, for example. In the illustrated embodiment, the latches 235 can be released (allowing the table top 201 to rise) by actuating the first and second actuators 207, 209.

The table top 201 is mounted on the leg assembly 203. The leg assembly 203 can support the table top 201. The table top 201 may be supported in a generally horizontal position. In some embodiments, the table top 201 maintains a generally horizontal position as it is adjusted up and down. This may advantageously allow adjustment without requiring the table top 201 to be emptied before adjustment.

The leg assembly 203 can comprise a first scissor mechanism 211 and a second scissor mechanism 213. The first scissor mechanism 211 can comprise a first leg 215 and a second leg 217. The first leg 215 and the second leg 217 can be joined by a pivot 219. In some embodiments, the pivot 219 includes a torsion element, such as a spring (not illustrated). The first scissor mechanism 211 can be positioned toward a front side of the workstation 100. The second scissor mechanism 213 can comprise a first leg 221 and a second leg 223. The first leg 221 and the second leg 223 can be joined by a pivot 225 (see FIG. 2B). In some embodiments, the pivot 225 includes a torsion element, such as a spring (not illustrated). The second scissor mechanism 213 can be positioned toward a back side of the workstation 200.

The angle (measured at the pivots) between the first and second legs of the first and second scissor mechanisms 211, 213 can be varied or adjusted to adjust the height of the leg assembly 203 and the table top 201. For example, as the angle between the first and second legs goes to zero the table top 201 is lowered toward the base frame 205. As the angle between the first and second legs increases, the table top 201 is raised away from the base frame 205.

In the illustrated embodiment, the first leg 215 of the first scissor mechanism 211 is attached to the base frame 205 by a pivot 231. The pivot 231 can allow the lower portion of the first leg 215 of the first scissor mechanism 211 to pivot or rotate relative to the base frame 205. In some embodiments, the pivot 231 includes a torsion element, such as a spring (not illustrated). The second leg 217 of the first scissor mechanism 211 is attached to the base frame by a roller 232. The roller 232 can be received in a roller tray 233 attached to the base frame 205. The roller 232 and roller tray 233 can allow the second leg 217 to roll or slide along the base frame 205 to allow the first scissor mechanism 211 to be adjusted up and down.

The first leg 221 of the second scissor mechanism 213 can be attached to the base frame 205 by a pivot 231. The pivot 231 can allow the lower portion of the first leg 221 of the second scissor mechanism 213 to pivot or rotate relative to the base frame 205. In some embodiments, the pivot 231 includes a torsion element, such as a spring (not illustrated). The second leg 223 of the second scissor mechanism 213 can be attached to the base frame 205 by a roller 232. The roller 232 can be received in a roller tray 233 attached to the base frame 205. The roller 232 and roller tray 233 can allow the second leg 223 to roll or slide along the base frame 205 to allow the first scissor mechanism 211 to be adjusted up and down.

As illustrated, for some embodiments, the pivots 231 are positioned on opposite corners of the base frame 205, and the roller trays 233 are positioned on opposite corners of the base frame 205. Accordingly, in the second workstation 200, the first scissor mechanism 211 may be staggered or offset relative to the second scissor mechanism 213. That is, the first scissor mechanism 211 may be positioned towards one lateral side of the workstation 200 and the second scissor mechanism 213 may be positioned towards the opposite lateral side of the workstation 200. As will be described below, this may permit the first and second scissor mechanisms 211, 231 to be actuated by the actuation mechanism 206.

In the illustrated embodiment, the first leg 215 of the first scissor mechanism 211 is attached to the base frame 205 by a pivot 231. The pivot 231 can allow the lower portion of the first leg 215 of the first scissor mechanism 211 to pivot or rotate relative to the base frame 205. In some embodiments, the pivot 231 includes a torsion element, such as a spring (not illustrated). The second leg 217 of the first scissor mechanism 211 is attached to the base frame by a roller 232. The roller 232 can be received in a roller tray 233 attached to the base frame 205. The roller 232 and roller tray 233 can allow the second leg 217 to roll or slide along the base frame 205 to allow the first scissor mechanism 211 to be adjusted up and down.

As shown in FIG. 2B, the first leg 215 of the first scissor mechanism 211 is attached to the table top 201 by a pin positioned within a slot 239. The slot 239 is attached to the underside of the table top 201. The pin can be free within the slot such that the upper end of the first leg 215 can move back and forth (within the slot 239) relative to the table top 201. The second leg 217 of the first scissor mechanism 211 can be attached to the table top 201 by a pivot 237. The pivot 237 can allow the second leg 217 of the first scissor mechanism 211 to pivot or rotate relative to the table top 201. In some embodiments, the pivot 237 includes a torsion element, such as a spring (not illustrated).

Similarly, the first leg 221 of the second scissor mechanism 213 is attached to the table top 201 by a pin positioned within a slot 239. The slot 239 is attached to the underside of the table top 201. The pin can be free within the slot such that the upper end of the first leg 221 can move back and forth (within the slot 239) relative to the table top 201. The second leg 223 of the second scissor mechanism 213 can be attached to the table top 201 by a pivot 237. The pivot 237 can allow the second leg 223 of the second scissor mechanism 213 to pivot or rotate relative to the table top 201. In some embodiments, the pivot 237 includes a torsion element, such as a spring (not illustrated). As illustrated, for some embodiments, the pivots 237 are positioned on opposite corners of the underside table top 201, and the slots 239 are positioned on opposite corners of the underside table top 201.

In some embodiments, the underside of the table top 201 can include one or more additional features. For example, bumpers (not illustrated) can be positioned on the underside of the table top 201. The bumpers can be formed of a rubberized material, for example. The bumpers can be positioned to contact the base frame 205 when the table top 201 is completely lowered onto the base frame 205. Springs 245, such as the illustrated leaf springs, can also be positioned on the underside of the table top 201. The springs 245 can be positioned to cushion the table top 201 as it is lowered all the way to the base frame 2 and/or to provide additional force for lifting the table top 201 away from the base frame 205 from the completely lowered position. The springs 245 can be positioned to contact either the legs of the first and second scissor mechanisms 211, 213 and/or the base frame 205.

As shown, the adjustment mechanism 206 may also be positioned on the bottom surface of the table top 201. The adjustment mechanism 206 will be described in detail below with reference to FIGS. 2C-2G. The adjustment mechanism 206 can act on the first and second scissor mechanisms 211, 213 to adjust the height of the table top 201 relative to the base frame 205.

The base frame 205 is illustrated in FIGS. 2A and 2B. As illustrated, for some embodiments, the base frame 205 comprises a generally rectangular frame structure. The frame structure can comprise other shapes. The base frame 205 can be made from a single piece (i.e., a unitary construction) or multiple pieces joined together (e.g., by adhesives, welding, fasteners, etc.) As described above, the lower ends of the first and second scissor mechanisms 211, 213 are attached to the base frame 205. In some embodiments, when the table top 201 is completely lowered, the table top 201 rests substantially on top of (e.g., contacts) the top of the base frame 205. In some embodiments, in the lowered position, the first and second scissor mechanisms 211, 213 can collapse such that they are positioned within base frame 205 (i.e., received within the opening created by the generally rectangular frame structure). This can provide that, when lowered, the workstation 200 is substantially thin. For example, in the lowered configuration, the workstation 200 can be less than 5 inches thick, less than 4 inches thick, less than 3 inches thick, less than 2 inches thick, or less than 1 inch thick.

The base frame 205 is configured to support the workstation 200. In some embodiments, the base frame 205 is configured to be placed on the surface of a conventional workstation, such as a desk. The table top 201 can then be raised or lowered relative to the base frame 205 to provide an adjustable workstation surface above the conventional desk. This can convert a traditional workstation into an adjustable workstation. In some embodiments, the base frame 205 is configured to be placed on the floor and the workstation 200 is adjustable from heights which would permit use by a seated user to heights that would permit use by a standing user.

Figure 2C:
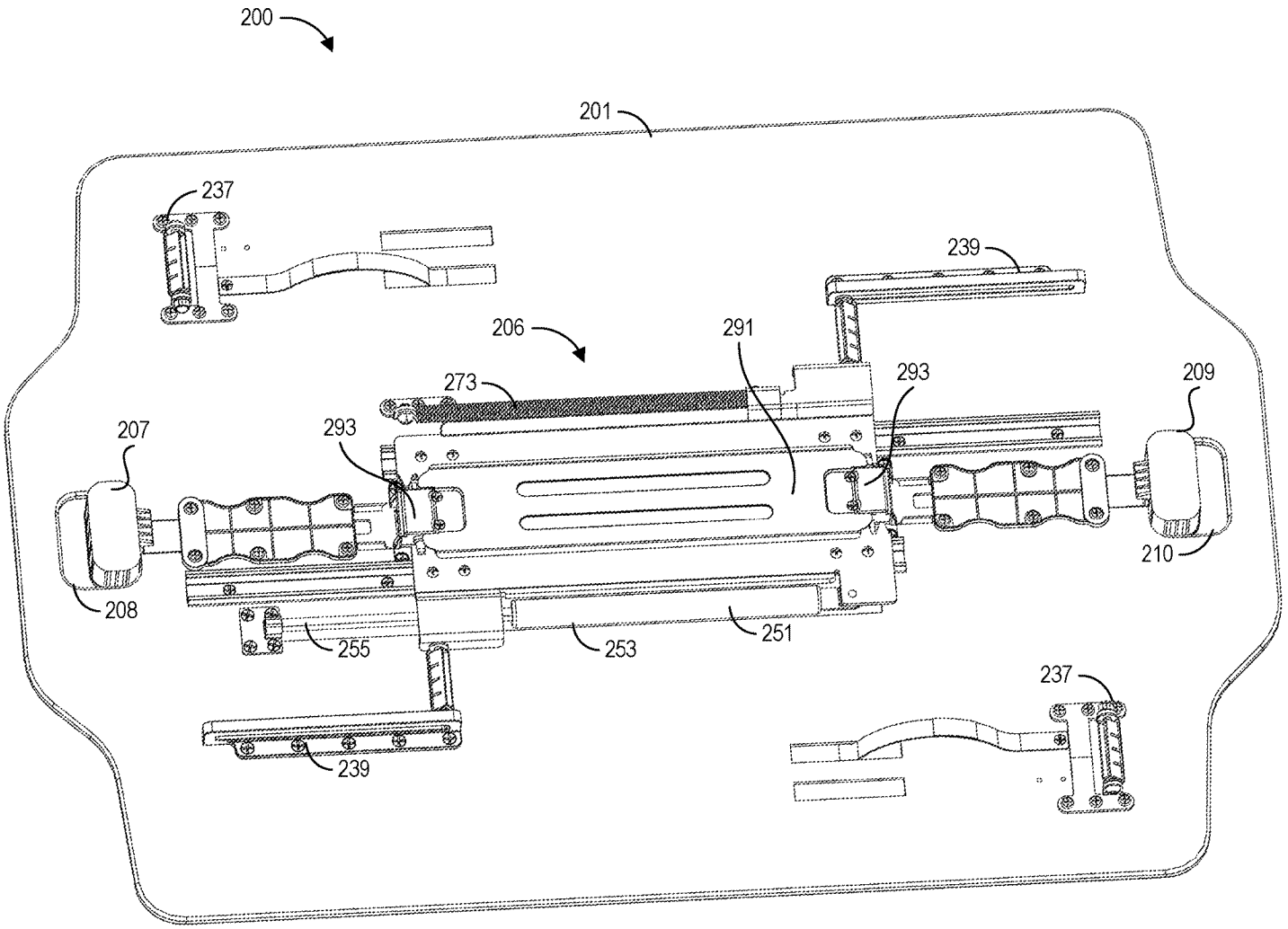
FIG. 2C is a bottom isometric view of the height adjustable workstation of FIG. 2A shown with legs removed to illustrate an embodiment of an adjustment mechanism thereof.
Figure 2D:
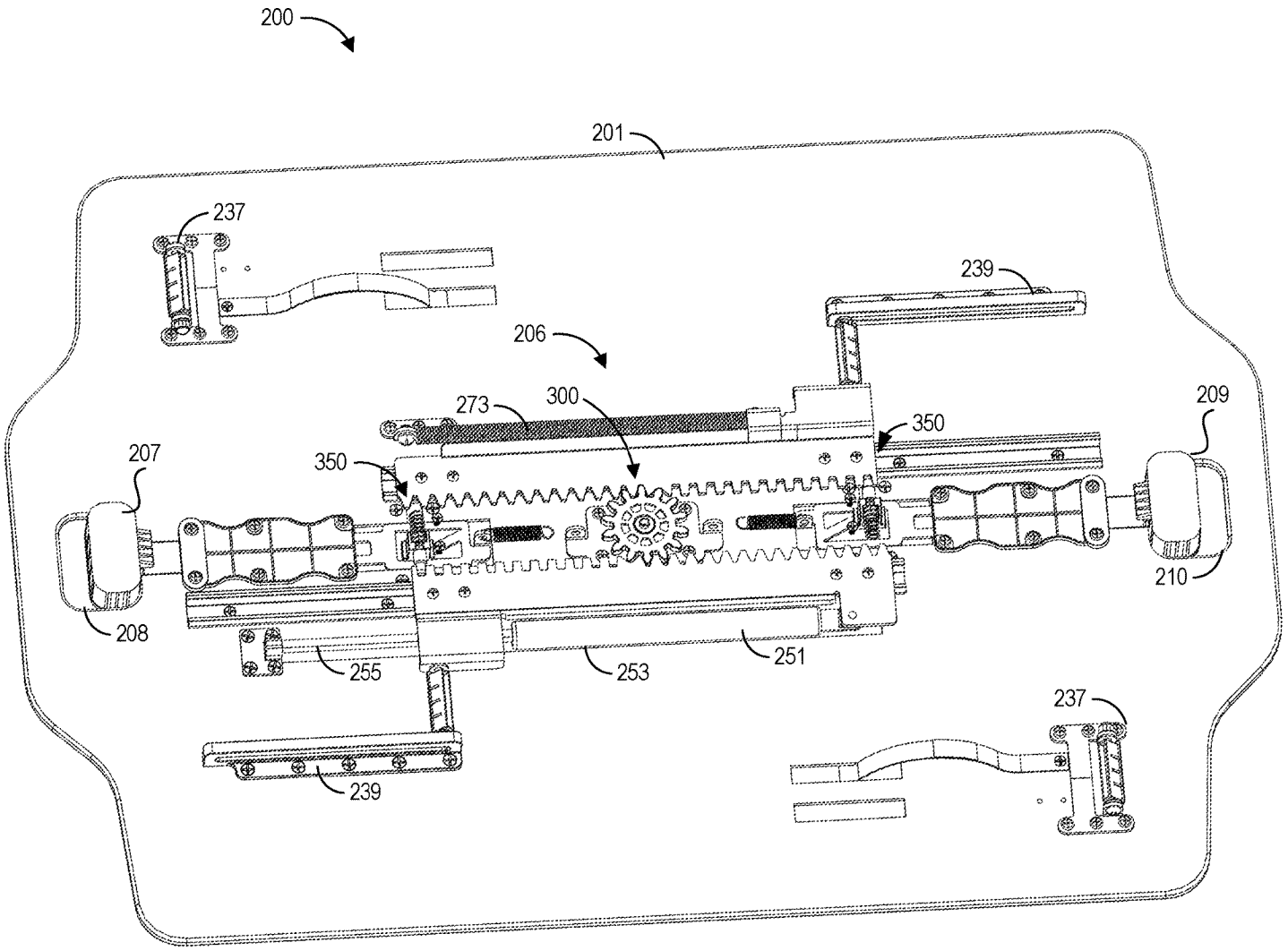
FIG. 2D is a bottom isometric view of the height adjustable workstation of FIG. 2A shown with the legs and certain covers removed to illustrate internal mechanisms of the adjustment mechanism.
Figure 2E:
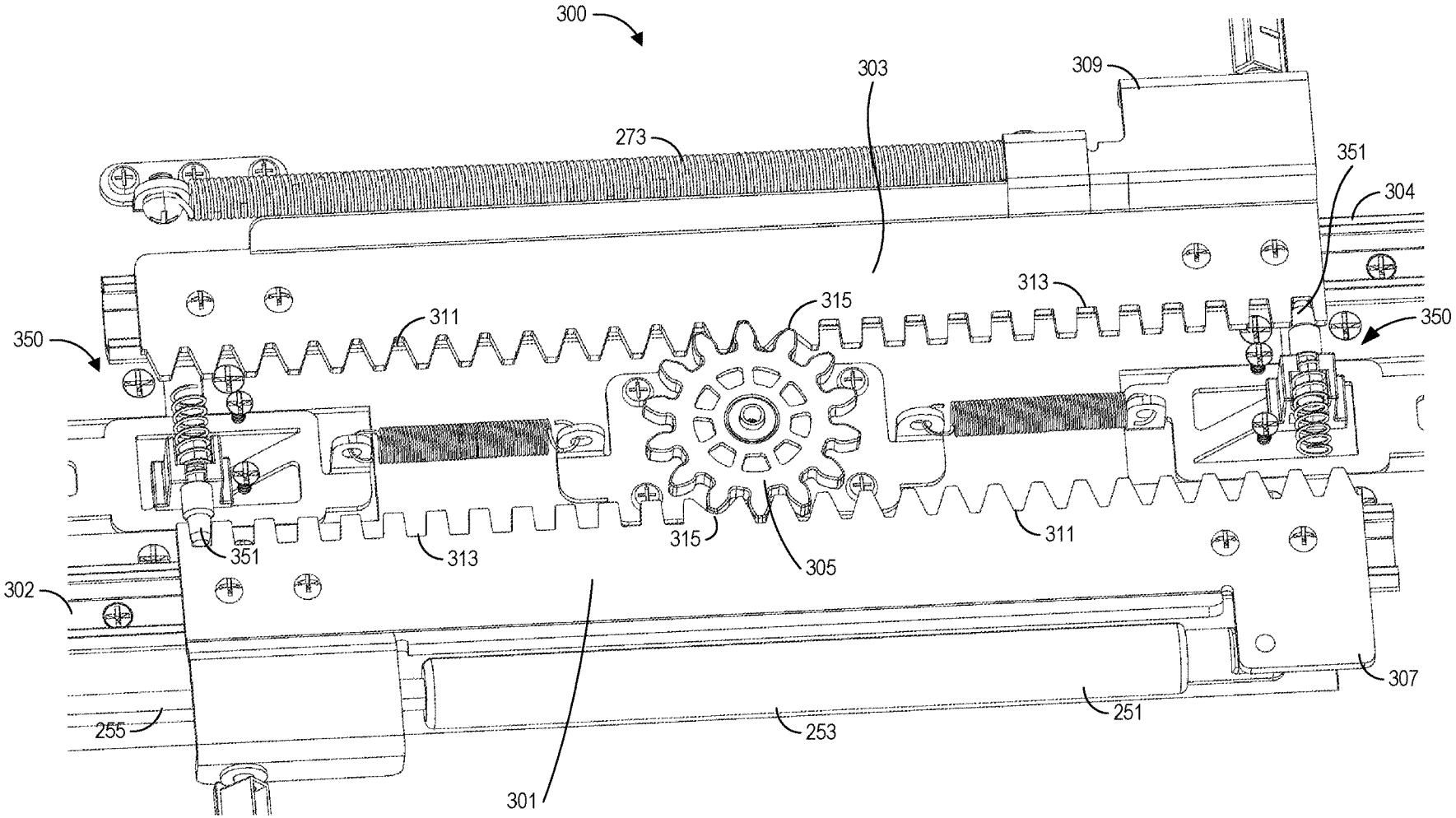
FIG. 2E is a detail view of a rack and pinion mechanism of the adjustment mechanism of the height adjustable workstation of FIG. 2C.
Figure 2F:
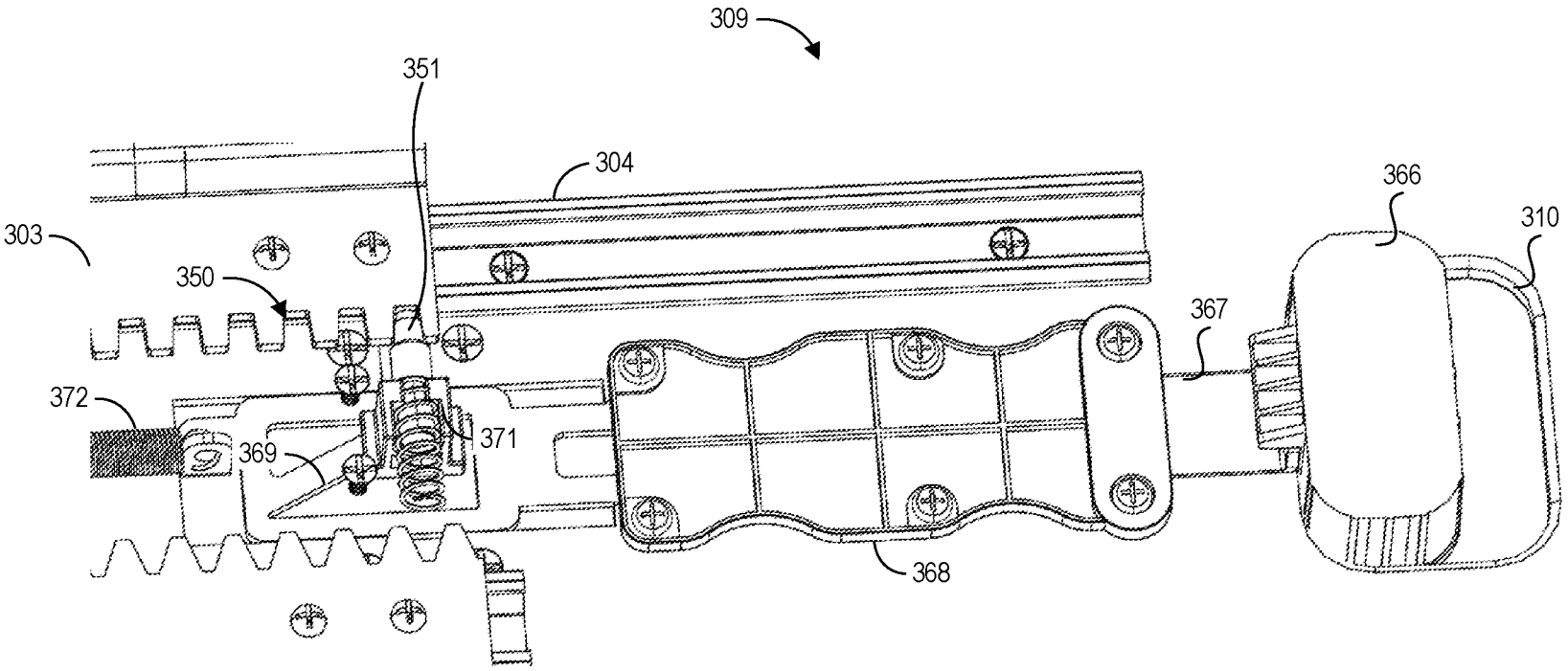
FIG. 2F is a detail view of a locking mechanism for the adjustment mechanism of the height adjustable workstation of FIG. 2C.
Figure 2G:
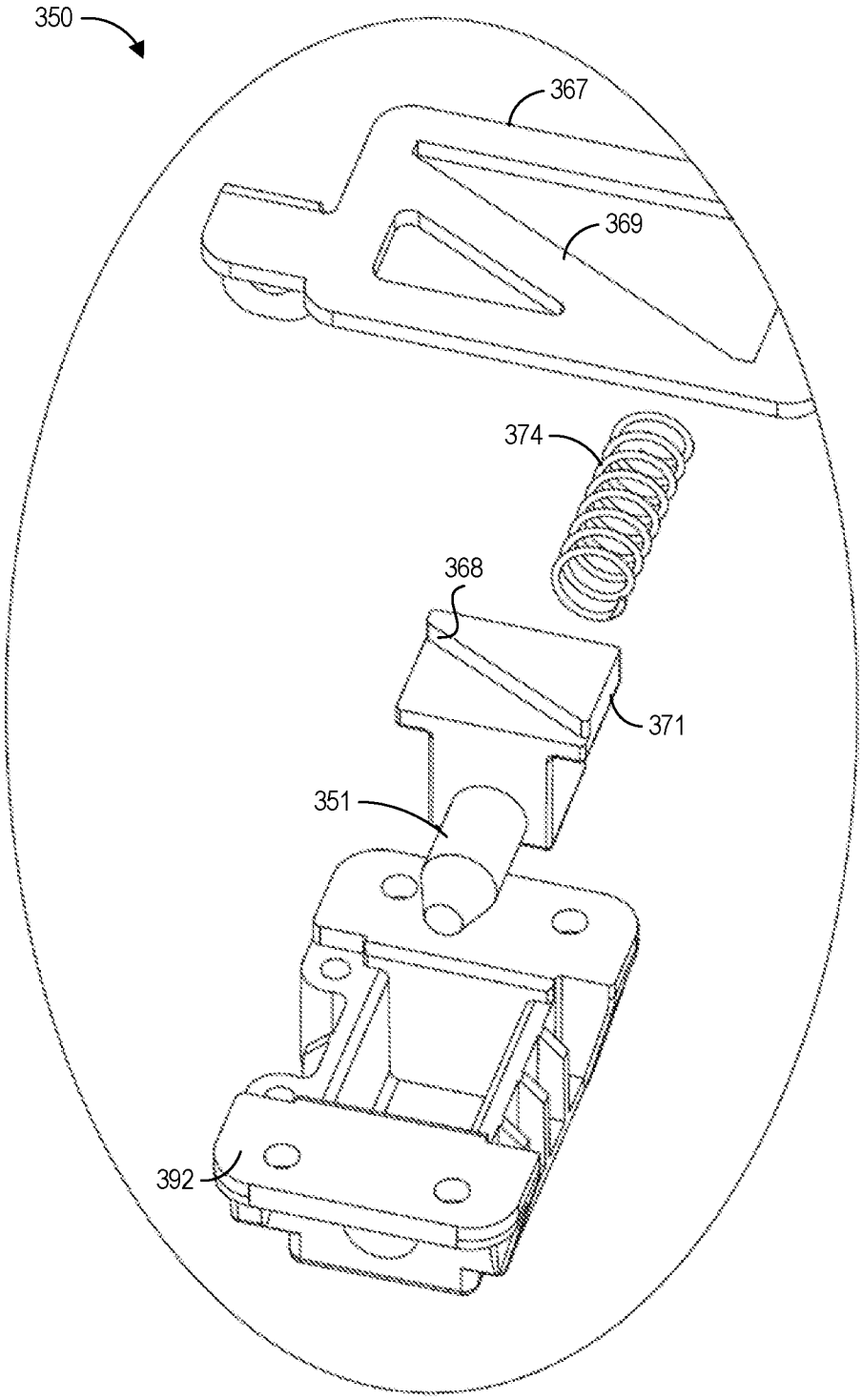
FIG. 2G is a bottom exploded view of the locking mechanism of FIG. 2F.

Turning now to FIGS. 2C-2G, an embodiment of the adjustment mechanism 206 of the workstation 200 is shown in greater detail. FIG. 2C is a bottom isometric view of the height adjustable workstation 200 shown with legs removed to the adjustment mechanism 206. FIG. 2D is a bottom isometric view of the height adjustable workstation 200 shown with the legs and certain covers removed to illustrate internal mechanisms of the adjustment mechanism 206. FIG. 2E is a detail view of a rack and pinion mechanism 300 of the adjustment mechanism 206. FIG. 2F is a detail view of a locking mechanism 350 for the adjustment mechanism 206. FIG. 2G is a bottom exploded view of the locking mechanism 350. As mentioned previously, the adjustment mechanism 206 is actuable to permit adjustment of the height of the table top 201 relative to the base frame 205.

As illustrated in FIG. 2C, for some embodiments, the adjustment mechanism 206 includes a gas spring 251. The gas spring 251 can include a cylinder 253 and a piston rod 255. The gas spring 251 can use compressed gas contained within the cylinder 253 to pneumatically store potential energy and withstand external force applied to the piston rod 255. The stored potential energy 253 can be released to permit the gas spring 251 to provide a force with the piston rod 255. Many types of gas springs 251 can be used as apparent to those of ordinary skill in the art upon consideration of this disclosure. In some embodiments, only a single gas spring 251 is used. In some embodiments, multiple gas springs 251 can be used. As will be described below, the gas spring 251 can supply force to aid a user in raising and lowering the workstation 200.

As also shown in FIG. 2C, various covers 291, 292 may cover certain internal components of the adjustment mechanism 206. FIG. 2D illustrates the adjustment mechanism 206 with the covers 291, 292 removed. As shown in FIG. 2D, the adjustment mechanism comprises a rack and pinion mechanism 300 and two locking mechanisms 350. FIG. 2E provides a detail view of the rack and pinion mechanism 300 and locking mechanisms 350.

In the illustrated embodiment, the rack and pinion mechanism 300 includes a first rack 301 and a second rack 303 engaged with a pinion gear 305. The first and second racks 301, 303 are mounted on slides 302, 304, respectively. The slides 302, 304 can be attached to the underside of the table top 201. The slides 302, 304 can permit the first and second racks 301, 303 to move back and forth along the slides as the pinion gear 305 rotates. In some embodiments, because the pinion gear 305 is engaged with teeth on both of the first and second racks 301, 303, the first and second racks move together, albeit in opposite directions.

The first rack 305 can be connected to the cylinder 253 of the gas spring 251 at a first flange 307. The opposite end of the gas spring 251 (i.e., the free end of the piston rod 255) can be fixedly attached to the underside of the table top 201, for example, by a bracket. When the piston rod 255 is compressed into the cylinder 253, the gas spring 251 can generate a reactive force. The gas spring 251 can be positioned such that when compressed, the cylinder 253 exerts a force on the first rack 301 (via the flange 307) that causes the rack 301 to move along the slide 302 away from the piston rod 255. The first rack 301 can also be attached to the slot 239 via the pin which connects to the second leg 217 of the first scissor mechanism 211. Thus, as the rack 301 moves, the force is transmitted to the first scissor mechanism 211 to open and close the leg assembly 203 to raise and lower the table top 201.

As the rack 301 moves, the pinion gear 305 rotates causing the second rack 303 to move in the opposite direction of the first rack 301. Motion of the second rack 303 can also be assisted by a mechanical spring 273 connected between a flange 309 and the underside of the table top 201. The second rack 303 can also be attached to the slot 239 via the pin which connects to the second leg 223 of the second scissor mechanism 213. Thus, as the rack 303 moves, the force is transmitted to the second scissor mechanism 213 to open and close the leg assembly 203 to raise and lower the table top 201.

As best seen in FIG. 2E, the first and second racks 301, 303 can include variously formed teeth. For example, a first portion of the teeth 311 can be configured to engage the pinion gear 305. The profile of these teeth 311 can be configured to match and mesh with the teeth of the pinion gear 305. In the illustrated embodiment, the teeth 311 have a triangular shape, although other shapes are possible. A second portion of the teeth 313 can be configured to engage with the locking mechanism 350 (as will be described below) to lock the height of the workstation 200 in place. These teeth 313 can have a profile configured to engage a locking pawl 351 of the locking mechanisms 350. In the illustrated embodiment, these teeth have a square profile, although other shapes are possible. The first and second teeth 311, 313 can be separated by a stop tooth 315. The stop tooth 315 is configured to limit motion of the racks 301, 303 in one direction. For example, the pinion gear 305 may not be able to rotate past the stop tooth 315.

The locking pawls 351 of the locking mechanisms can be spring loaded, so as to insert into the teeth 315 of the racks 301, 303. When engaged, the locking pawls prevent movement of the racks 301, 303, thereby preventing movement of the leg assembly 203 and locking the height of the workstation in place. The locking pawls 351 can be released by actuating the first and second actuators 307, 309.

FIG. 2F is a detail view of a locking mechanism 350 for the adjustment mechanism 206. FIG. 2F illustrates how the second actuator 309 may be actuated to release the locking pawl 351 and allow adjustment of the height of the workstation 200. Although not shown, a similar locking mechanism 300 can be actuated by the first actuator 307 to release the other locking pawl 351. In some embodiments, both actuators 307, 309 must be actuated simultaneously, to release both locking pawls 351 to permit adjustment of the height of the workstation 200. This can provide a safety feature as accidental actuation of one of the actuators 307, 309 is not sufficient to allow the height of the workstation to be adjusted.

As shown in FIG. 2F, the actuator 309 comprises an actuator handle 366, an actuator arm 167, an angled surface 369. The actuator handle 366 can be attached to the actuator arm 367. The actuator arm 367 can extend below a bracket 368, which is attached to the underside of the table top 201. In some embodiments, the underside of the table top 201 includes a groove below the bracket 368 to accommodate the actuator arm 367. Opposite the actuator handle 366, the angled surface 369 is formed in the actuator arm 367. The angled surface 369 extends at an angle relative to the longitudinal axis of the actuator arm 367. The inner most end of the actuator arm 367 is attached to a spring 372 that biases the actuator arm 367 toward the center of the table top 201.

The locking pawl 351 can be mounted in a housing 371. The housing 371 can be configured to ride along the angled surface 369. For example, as the actuator handle 366 is pulled outwardly, the housing 371 rides up along the angled surface 369, withdrawing the locking pawl 351 from the teeth of the rack 303. This may allow the rack 303 to move and the height of the workstation 200 to be adjusted.

FIG. 2G is a bottom exploded view of the locking mechanism 350. In this view, an angled surface 368 of the housing 371 can be seen. When assembled, the angled surface 368 of the housing can contact and ride along the angled surface 369 of the actuator arm 367. A spring 374 positioned between the housing 371 and the cover 392, can bias the housing 371 and locking pawl 351 toward the teeth of the rack 303.

With reference to FIGS. 2D-2G, the operation of the adjustment mechanism 206 will now be described. To move the workstation 200 from an elevated position (e.g., as shown in FIGS. 2A and 2B) to a lowered position, a user may pull the first and second actuators 207, 209 outwardly. As described above, this can withdraw the locking pawls 351 from the teeth of the racks 301, 303. The weight of objects on the table top 201 and/or a force applied by the user can then be used to lower the table top 201 toward the base frame 205. The gas spring 251 may provide a dampening effect to help control the descent of the table top 201. Additionally, as the table top 201 descends, the spring 273 may be stretched, providing a resistive force that further controls the descent of the table top 201. This can allow the user to control the descent of the table top 201 in a simple manor that requires little human force. To set the height of the table top 201, the user need only release the first and/or second actuators 207, 209.

To move the workstation 200 from a lowered position to an elevated position, a user may again pull the first and second actuators 207, 209 outwardly to free the locking pawls 351. Because the gas spring 251 is in a compressed position when the table top 201 is lowered, the gas spring 251 may provide a force that raises the table top 201. The force from the gas spring 251 may be supplemented by the force provided by the spring 273 and/or an additional force provided by the user. Again, to set the height of the table top 201, the user need only release the first and/or second actuators 207, 209.

The actuation mechanism 206 can be configured to provide stepped motion of the workstation 200. That is, in some embodiments, the height of the table top 201 can only be set at intervals determined by the teeth of the racks 301, 303.

The actuator mechanism 206 thus can be configured to permit simple adjustment of the height of the workstation 200. Adjusting the strength of the gas spring 251 and/or spring 273 can permit balancing such that minimal human force is required to raise or lower the workstation 200. In some embodiments, raising or lowering the workstation 200 requires less than 15 pounds of force, less than 10 pounds of force, less than 5 pounds of force, or less than 2.5 pounds of force. In some embodiments, the workstation 200 is adjustable up to 8 inches, 12 inches, 16 inches, 20 inches, 24 inches, 28 inches, 32 inches, 36 inches, 40 inches, 44 inches, 48 inches, or higher. In some embodiments, the workstation can support at least 10 pounds, at least 20 pounds, at least 25 pounds, at least 30 pounds, at least 35 pounds, at least 40 pounds, or at least 50 pounds, or more.

Figure 3:
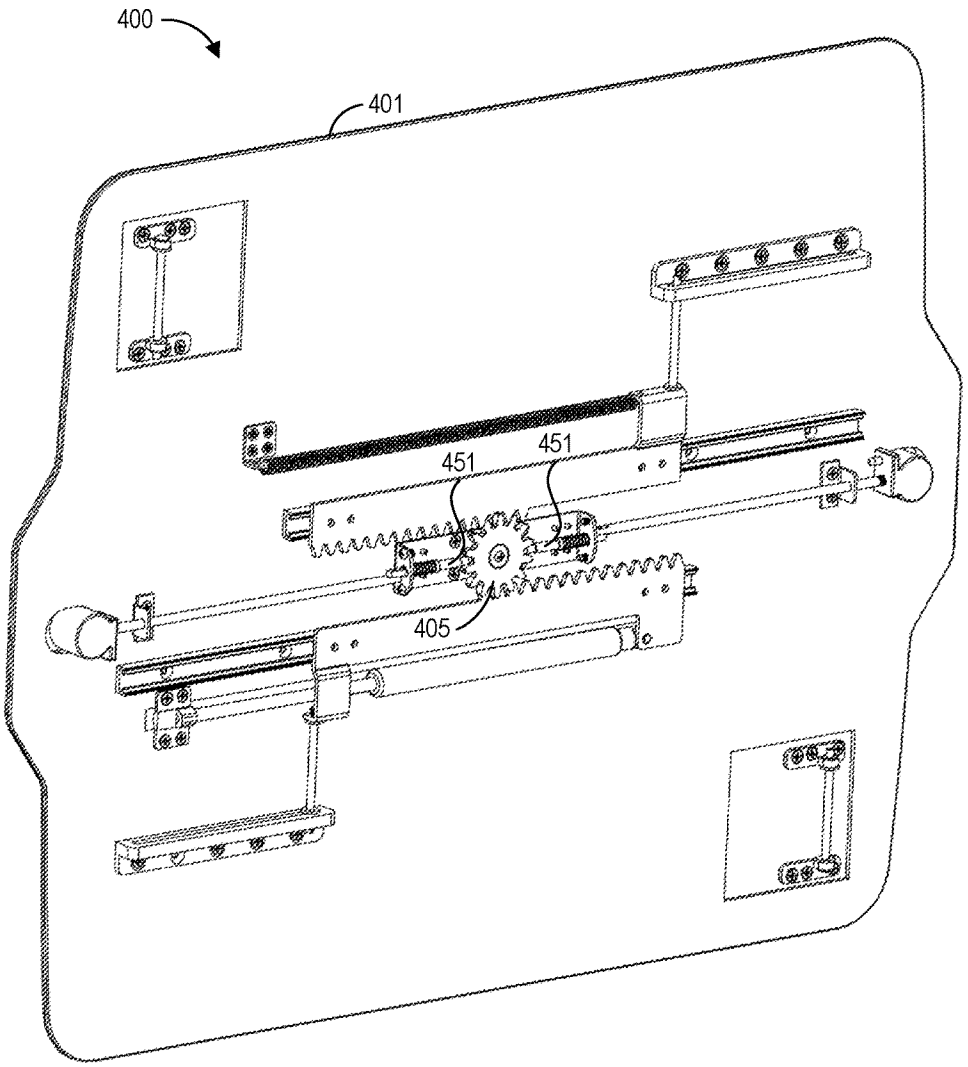
FIG. 3 is a bottom isometric view of a third embodiment of a height adjustable workstation illustrated with legs removed to illustrate an adjustment mechanism thereof.

FIG. 3 is a bottom isometric view of a third embodiment of a height adjustable workstation 400 illustrated with legs removed to illustrate an adjustment mechanism thereof. In many aspects, the workstation 400 may be similar to the workstation 200 previously described. A primary difference is that in the workstation 400, locking pawls 451 engage with a pinion gear 405 instead of the racks to limit motion of the table top 401.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the figures may be combined, interchanged or excluded from other embodiments.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims. Applicant reserves the right to submit claims directed to combinations and sub-combinations of the disclosed inventions that are believed to be novel and non-obvious. Inventions embodied in other combinations and sub-combinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

What is claimed is:

1. An adjustable workstation, comprising:

a table top having an upper side and an opposed underside;

a legs assembly comprising at least a first scissor mechanism including a first leg and a second leg, a top of the first leg pivotally attached to the underside of the table top, a top of the second leg slidingly engaged with a groove attached to the underside of the table top;

a base frame, a bottom of the first leg comprising a roller engaged with a roller tray on the base frame, a bottom of the second leg pivotally attached to the base frame; and an adjustment mechanism configured to move the legs assembly to adjust a height of the table top relative to the base frame, the adjustment mechanism comprising:

a rack and pinion mechanism comprising a first rack engaged with a pinion gear, the first rack mounted on a slide such that the first rack can move back and forth along the slide as the pinion gear rotates, a first locking mechanism, comprising a spring loaded locking pawl configured to engage the first rack to prevent movement of the first rack, a gas spring comprising a cylinder and a piston rod, wherein a free end of the piston rod is attached to the underside of the table, and an end of the cylinder is attached to the first rack, and a first actuator configured to release the locking pawl to allow the first rack to move, wherein the first actuator comprises an actuator arm extending along an axis, an actuator handle positioned at a first end of the actuator arm, a first surface formed at an angle with respect the axis positioned at a second end of the actuator arm, and a movable housing having a second surface configured to slidingly contact the first surface so as to move along the first surface as the first actuator is actuated, wherein the spring loaded locking pawl is connected to the moveable housing, wherein movement of the moveable housing engages and disengages the locking pawl, wherein the first actuator is actuated by pulling the handle along the axis of actuator arm, and wherein the locking pawl moves along a second axis that is orthogonal to the axis of the actuator arm;

wherein, upon actuation of the actuator, the height of the table top relative to the base frame is adjustable, and upon release of the actuator, the height of the table top relative to the base frame remains fixed.

2. The adjustable workstation of claim 1, wherein the adjustment mechanism further comprises:

a second rack engaged with the pinion gear, the second rack mounted on a slide such that the second rack can move back and forth along the slide as the pinion gear rotates, a second locking mechanism, comprising a spring loaded locking pawl configured to engage the second rack to prevent movement of the second rack, a spring extending between the second rack and a bracket mounted on the underside of the table, and a second actuator configured to release the locking pawl to allow the second rack to move.

3. The adjustable workstation of claim 2, wherein both the first actuator and the second actuator must be actuated to adjust the height of the table top.

4. The adjustable workstation of claim 2, wherein the legs assembly further comprises a second scissor mechanism including a first leg and a second leg, a top of the first leg pivotally attached to the underside of the table top, a top of the second leg slidingly engaged with a groove attached to the underside of the table top.

5. The adjustable workstation of claim 4, wherein the first and second scissor mechanisms are staggered.

6. The adjustable workstation of claim 4, wherein the roller tray of the first scissor mechanism and the roller tray of the second scissor mechanism are located in opposite corners of the base frame.

7. The adjustable workstation of claim 1, wherein the actuator handle is positioned within an opening in the table top.

8. The adjustable workstation of claim 7, wherein the first actuator is configured to be actuated by pulling the actuator handle outwardly.

* * * * *